US006682236B2

(12) United States Patent
Higuchi

(10) Patent No.: US 6,682,236 B2
(45) Date of Patent: Jan. 27, 2004

(54) PRINTING APPARATUS, PRINT CONTROL APPARATUS, AND METHOD FOR USE IN THOSE APPARATUSES

(75) Inventor: Yuichi Higuchi, Funabashi (JP)

(73) Assignee: Canon Kabushiki Kaisha, Tokyo (JP)

( * ) Notice: Subject to any disclaimer, the term of this patent is extended or adjusted under 35 U.S.C. 154(b) by 108 days.

(21) Appl. No.: 09/901,687

(22) Filed: Jul. 11, 2001

(65) Prior Publication Data

US 2001/0043830 A1 Nov. 22, 2001

Related U.S. Application Data

(62) Division of application No. 09/184,656, filed on Nov. 3, 1998, now Pat. No. 6,283,653.

(30) Foreign Application Priority Data

Nov. 5, 1997 (JP) ..... 9-302342

(51) Int. Cl.[7] ..... B41J 11/42

(52) U.S. Cl. ..... 400/582; 358/1.5; 358/1.6; 358/1.9

(58) Field of Search ..... 400/582; 358/1.9, 358/1.5, 1.6

(56) References Cited

U.S. PATENT DOCUMENTS

| | | | | |
|---|---|---|---|---|
| 4,725,857 A | | 2/1988 | Piatt et al. | 271/9 |
| 4,927,277 A | | 5/1990 | Niikawa | 400/56 |
| 5,005,746 A | | 4/1991 | Murakami et al. | 226/101 |
| 5,141,346 A | | 8/1992 | Nakagawa | 400/605 |
| 5,305,020 A | | 4/1994 | Gibbons et al. | 346/76 PH |
| 5,816,716 A | | 10/1998 | Sugiyama | 400/578 |
| 5,835,820 A | | 11/1998 | Martin et al. | 399/85 |
| 6,009,242 A | | 12/1999 | Anzai | 395/114 |
| 6,039,426 A | * | 3/2000 | Dobbs | 347/19 |
| 6,327,051 B1 | * | 12/2001 | Moro et al. | 358/1.9 |

* cited by examiner

*Primary Examiner*—Charles H. Nolan, Jr.
(74) *Attorney, Agent, or Firm*—Fitzpatrick, Cella, Harper & Scinto

(57) ABSTRACT

A printing apparatus having a plurality of print modes and a plurality of paper feeding means is constructed by means for designating the print mode, means for selecting the paper feeding means, and means for discriminating whether a print medium corresponding to the designated print mode coincides with a print medium corresponding to the selected paper feeding means or not.

9 Claims, 6 Drawing Sheets

| 501 PAPER FEEDER | 502 PRINT MODE |
|---|---|
| 503 MP | 504 THICK/OHP |
| 505 UPPER CASSETTE | 507 STANDARD/THICK |
| 507 LOWER CASSETTE | 508 STANDARD/THICK |

FIG. 5

| 601 | 602 | 603 | 604 |
|---|---|---|---|
| ESC | MT | PRINT MEDIUM | PAPER FEEDER |

FIG. 6

| 701 PAPER FEEDER | 702 PRINT MEDIUM |
|---|---|
| 703 MP | 704 THICK |
| 705 UPPER CASSETTE | 707 THICK |
| 707 LOWER CASSETTE | 708 STANDARD/THICK |

FIG. 7

PRINTING APPARATUS, PRINT CONTROL APPARATUS, AND METHOD FOR USE IN THOSE APPARATUSES

This is a divisional application of Ser. No. 09/184,656, filed on Nov. 3, 1998, allowed Apr. 4, 2001, now U.S. Pat. No. 6,283,653.

BACKGROUND OF THE INVENTION

1. Field of the Invention

The invention relates to a printing apparatus having a plurality of print modes and a plurality of paper feeders and relates to a print control apparatus and a method which is used for those apparatuses.

2. Related Background Art

In recent years, print documents have been formed by various print media in accordance with various applications. For example, not only a print document is printed to a standard paper in order to form a document or the like but also a print document is printed by various printing apparatuses to an OHP sheet for an OHP which is used for reading of researches or the like, a thick paper such as a postcard, or the like. Therefore, even in a printing apparatus for outputting a document formed by a word processor, a computer system, or the like, a function to print the document by a plurality of media such as OHP sheet, thick paper, and the like other than the standard paper is provided.

As for those print media, since features such as thickness, concave and convex states of the surface, hygroscopic property, and the like differ, a printing process is performed in accordance with each print medium. For example, since the thick paper such as a postcard or the like is thicker than the standard paper, a feed roller and a conveying roller adapted to the standard paper are improper for the thick paper. Since the ink cannot be uniformly transferred depending on the concave and convex states of the paper surface, a character quality deteriorates. Further, in the case where the hygroscopic property of the paper is low, there is a fear such that the printed characters blot.

In the printing apparatus, therefore, by presetting the print mode corresponding to a desired print medium, the proper printing processes corresponding to various print media can be performed.

In the case where the printing can be performed by a plurality of kinds of print media, if only one paper feeder is provided, it is troublesome to exchange the print media. To prevent such a problem, a plurality of paper feeders are usually provided. To print to a desired print medium, therefore, it is necessary not only to designate the print mode but also to select the paper feeder in which the desired print media are enclosed.

However, there is a problem such that a desired print quality cannot be obtained in the case where the print mode and the print medium are not matched as in a case where the operator erroneously designates the print mode, a case where even if the operator correctly designated the print mode, the print media corresponding to the designated print mode are not enclosed in the selected paper feeder, or the like.

SUMMARY OF THE INVENTION

It is, therefore, an object of the invention to provide a printing apparatus having a plurality of print modes and a plurality of paper feeders, wherein it is prevented that the printing is performed by different print media, and the printing can be certainly executed in a desired print mode or by a desired print medium.

To solve the above problems, according to the invention, there is provided a printing apparatus having a plurality of print modes and a plurality of paper feeders and in which predetermined print media are enclosed in each paper feeder, comprising: means for designating a print mode; means for selecting the paper feeder; and means for detecting whether the designated print mode and the print mode which is available in the selected paper feeder coincide or not.

The invention also uses a construction having means for detecting whether the print medium corresponding to the designated print mode and the print media enclosed in the selected paper feeder coincide or not.

According to this construction, since whether the designated print mode and the print mode which is available for the selected paper feeder coincide or not can be detected, the print data can be certainly outputted in the desired print mode. Since whether the print medium corresponding to the designated print mode and the print media enclosed in the selected paper feeder coincide or not can be detected, it is possible to prevent that the print data is outputted by the different print medium.

According to the invention, since whether the designated print mode and the print mode which is available for the selected paper feeder coincide or not can be detected, the print data can be certainly outputted in the desired print mode. Since whether the print medium corresponding to the designated print mode and the print media enclosed in the selected paper feeder coincide or not is detected, it is possible to prevent that the print data is outputted by the different print medium. In this case, by tentatively setting the print media enclosed in the paper feeder, even for a printing apparatus without a function for detecting the print media, it is possible to prevent that the print data is printed by a different print medium.

The above and other objects and features of the present invention will become apparent from the following detailed description and the appended claims with reference to the accompanying drawings.

BRIEF DESCRIPTION OF THE DRAWINGS

FIG. 5 is an explanatory diagram showing the relation between a paper feeder which is used in the invention and the print mode;

FIG. 6 is an explanatory diagram showing a command format of a print media setting command which is used in the invention;

FIG. 7 is an explanatory diagram showing the relation between the paper feeder which is used in the invention and the print medium which is tentatively set;

DETAILED DESCRIPTION OF THE PREFERRED EMBODIMENTS

Preferred embodiments of the invention will now be described in detail hereinbelow with reference to the drawings.

[First Embodiment]

Figure 1:
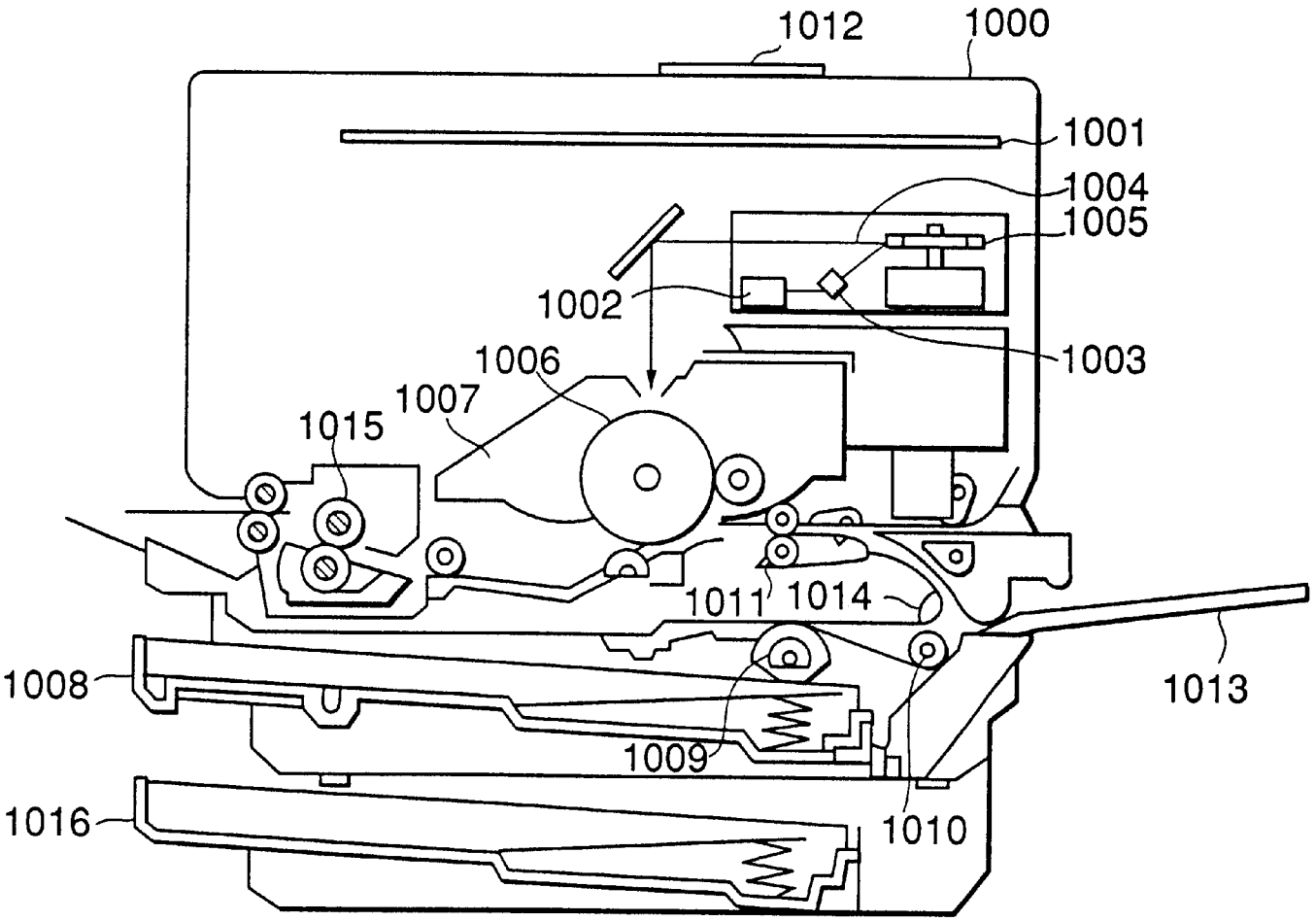
FIG. 1 is a cross sectional view showing a structure of a printing apparatus of the invention.

FIG. 1 is a cross sectional view showing an internal structure of a laser beam printer (hereinafter, abbreviated to an LBP) according to an embodiment of a printing apparatus. In this LBP, a character pattern, a regular format (form data), and the like can be registered from a data source (not shown). Reference numeral 1000 denotes an LBP main body for inputting and storing character information (character code), form information, a macro command, or the like which is supplied from host computers (201, 202, 203 in FIG. 2) connected to the outside, forming a corresponding character pattern, a form pattern, or the like in accordance with those information, and forming an image onto a print medium serving as a recording medium.

Reference numeral 1012 denotes an operation panel in which switches for operation and an LED display are arranged and 1001 indicates a printer control unit for performing a whole control of the LBP 1000 and analyzing the character information or the like which is supplied from the host computer. The control unit 1001 mainly converts the character information to a video signal of a corresponding character pattern and outputs to a laser driver 1002. The laser driver 1002 is a circuit for driving a semiconductor laser 1003 and on/off switches a laser beam 1004 which is emitted from the semiconductor laser 1003 in accordance with an inputted video signal.

The laser beam 1004 is swung to the right and left by a rotary polygon mirror 1005 and scans on an electrostatic drum 1006, so that an electrostatic latent image of the character pattern is formed on the electrostatic drum 1006. This latent image is developed by a developing unit 1007 arranged around the electrostatic drum 1006 and, after that, is transferred onto a print medium. The print medium is, for example, a cut sheet. The print medium of the cut sheet is enclosed in a paper cassette (paper feeder) 1008 attached to the LBP 1000, is picked up into the apparatus by a feed roller 1009 and conveying rollers 1010 and 1011, and is fed to the electrostatic drum 1006. The image transferred to the print medium is subsequently fixed by a fixing unit 1015. In this case, a fixing temperature is adjusted in accordance with the print mode designated from the host computer.

Reference numeral 1013 denotes a paper feed tray for taking the print medium into the apparatus by the conveying rollers 1010 and 1011. The kind of print medium which is fed from the paper cassette 1008, a paper cassette 1016, or the paper feed tray 1013 (hereinafter, they are generally referred to as a "paper feeder") is detected by a print medium detecting sensor 1014 provided in the paper feeding unit. Reference numeral 1016 denotes the cassette at the second stage which can enclose print media of the kind that is the same as or different from the kind of print media enclosed in the cassette at the first stage.

Figure 2:
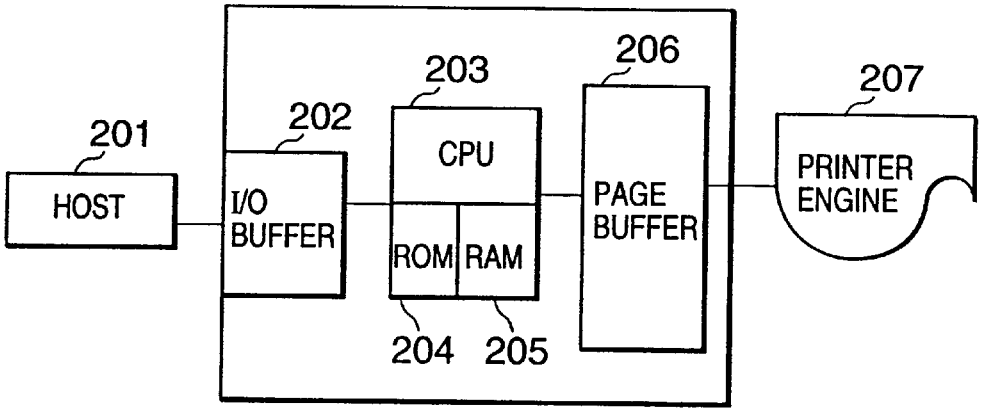
FIG. 2 is a block diagram showing a construction of the printing apparatus of the invention.

FIG. 2 is a diagram showing the relation between block constructional diagram of the LBP in the embodiment and a data generating source. Component elements 202 to 206 shown in the diagram are included in the foregoing printer control unit 1001 and a construction of a printer section is as described in FIG. 1.

Various data from the host computer 201 serving as a data source is supplied to the CPU 203 for controlling the controller through the input/output (I/O) buffer 202. A program and font patterns are stored in an ROM 204. Various processing data is stored into an RAM 205 serving as a work area. Developed images are stored into a page buffer 206. The developed images are printed onto the print medium through a printer engine 207.

Figure 3:
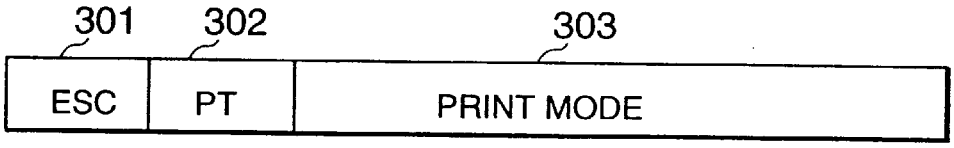
FIG. 3 is an explanatory diagram showing a command format of a print mode command which is used in the invention.
Figure 4:
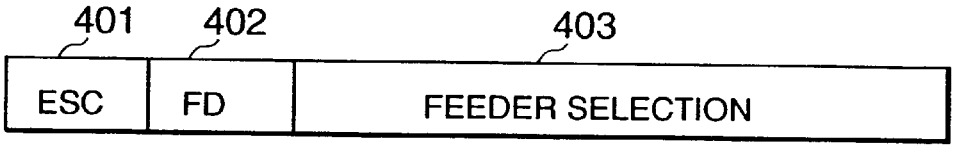
FIG. 4 is an explanatory diagram showing a command format of a paper feeder selecting command which is used in the invention.

FIG. 3 shows a command which is designated from the host 201 serving as a data source. This command is constructed by: an ESC code 301 showing that this command is a control command; a code 302 showing that this command is a designating command of the print mode; and a code 303 showing the print mode. FIG. 4 shows another command which is designated from the host 201. This command is constructed by: an ESC code 401 showing that the command is a control command; a code 402 showing that the command is a selecting command of a paper feeder; and a code 403 showing the contents of the paper feeder selection. As a code 403, in addition to the code corresponding to the paper feeder to be selected, a code to designate an automatic mode can be also used.

FIG. 5 is a diagram showing an example of the relation between the paper feeder and the print mode that can be designated. A left column 501 denotes a kind of paper feeder and a right column 502 shows a print mode which can be set to the paper feeder in the left column. For example, it is shown that a print mode "thick/OHP" 504 can be set to a multipurpose tray (hereinafter, abbreviated to an MP) 503 (corresponding to the paper feed tray 1013 in FIG. 1), a print mode "standard/thick" 506 can be set to an upper cassette 505 (corresponding to the paper feeder 1008 in FIG. 1), and a print mode "standard/thick" 508 can be set to an lower cassette 507 (corresponding to the paper feeder 1016 in FIG. 1), respectively.

Figure 8:
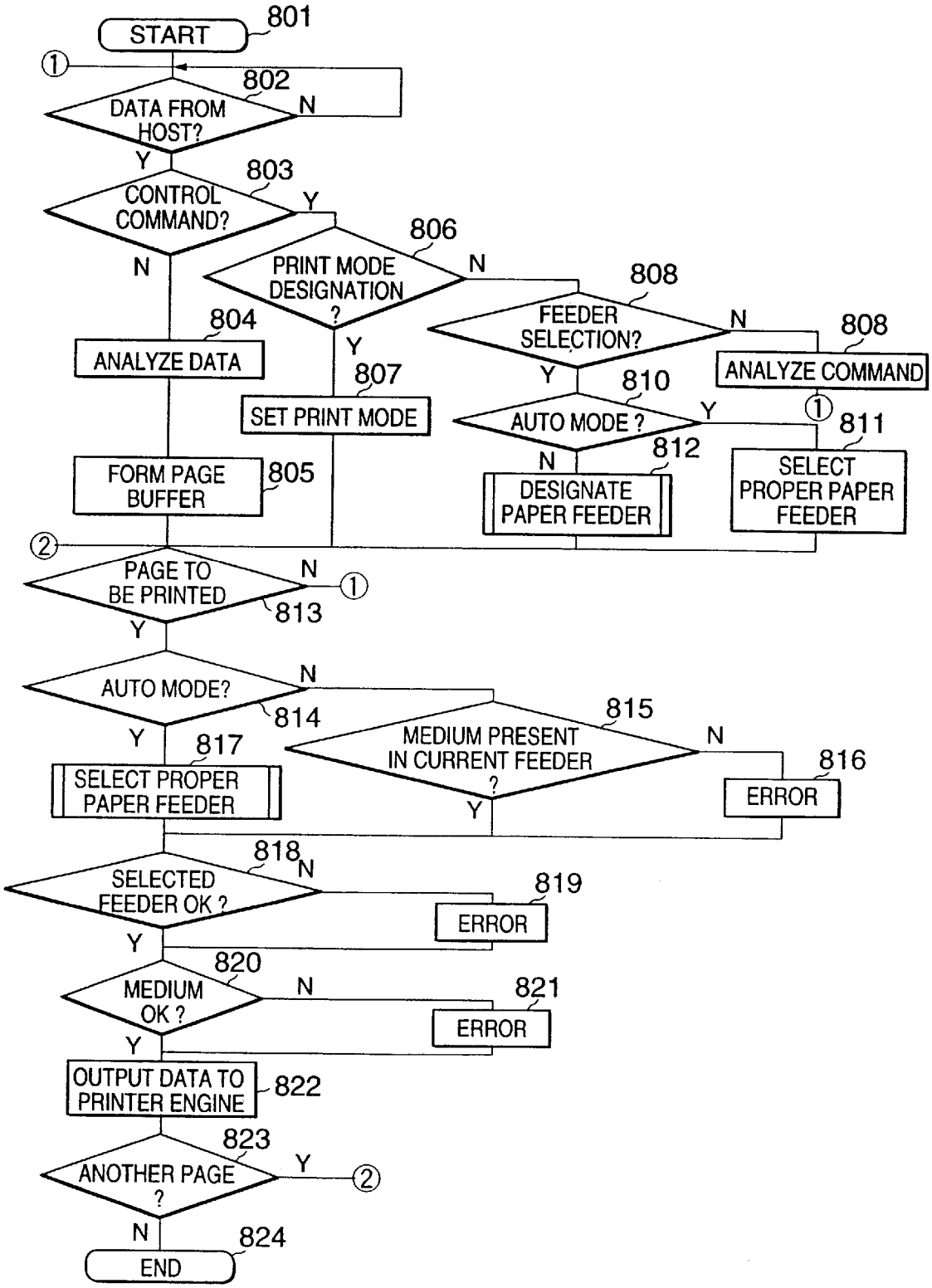
FIG. 8 is a flowchart showing a print processing procedure in the first embodiment of the invention.

A print processing procedure in the first embodiment of the invention will now be described hereinbelow with reference to a flowchart shown in FIG. 8.

In step 801, when a power source is turned on, the present program is started. In step 802, whether data has been received from the host computer 201 to a port or not is discriminated. When there is no data, this discrimination is repeated.

When the data is received, a check is made in step 803 to see if the received data is a control command. When it is not the control command, since this means that the received data is print data, the received data is analyzed and converted into an internal code in step 804. The internal code is written into the page buffer 206 in step 805.

When it is determined in step 803 that the received data is the control command, whether the control command is a designating command of the print mode or not is discriminated in step 806 by referring to the next code (code 302 in FIG. 3). When it is decided in step 806 that the control command is the designating command of the print mode, the print mode of the code 303 (FIG. 3) is set in step 807. When it is determined in step 806 that the control command is not the designating command of the print mode, a check is made in step 808 to see if it is a selecting command of the paper feeder. When it is decided in step 808 that the control command is not the selecting command of the paper feeder, the control command is analyzed in step 809 and is written into the page buffer 206 as necessary.

On the other hand, when it is determined in step 808 that the control command is the selecting command of the paper feeder, whether the foregoing automatic mode has been designated or not is confirmed in step 810 by referring to the code 403 in FIG. 4. When the selecting command of the paper feeder designates the automatic mode, a check is made in step 811 to see if the print medium exists in the current paper feeder. If there is no print medium, in step 807, the paper feeder in which the designated print mode is available is moved to the paper feeder in which the print media corresponding to the print mode exist as a selection target. The discrimination about the possibility can be made with reference to the relation between the columns 501 and 502 in FIG. 5. For example, in the case where the print mode relates to the standard paper, only the upper and lower paper feeders become the selection targets. On the contrary, when it is decided in step 810 that the selecting command is not the automatic mode, the designated paper feeder is selected in step 812. The selecting operation of the paper feeder in step 811 will now be described with reference to FIG. 10.

The paper feeder when the automatic mode is selected is selected as follows.

First in step A02, the designated print mode and medium are determined. When the print mode is not designated by the control command and step 807 in FIG. 8 is not executed, the print mode and medium are determined by those defined as a default. In step A03, the paper feeder is tentatively selected. In step A03, the paper feeder is sequentially selected until the paper feeder to be selected is determined. Ordinarily, the tray is first selected and, subsequently, the cassette is sequentially selected. In step A04, a check is made to see if the print mode designated by the selected paper feeder can be designated. If YES, in step A05, the presence or absence of the medium is discriminated and whether the present medium coincides with the designated medium or not is further checked. When the designated medium exists on the selected paper feeder, it is determined as a paper feeder to start the paper feed and a process A06 is finished.

In the case where the designated print mode is impossible in the selected paper feeder (in this example, when the OHP is designated in the cassette) or the case where no medium exists or, even if the medium exists, it is not the designated medium, a check is made in step A07 to see if all of the paper feeders have been confirmed. If NO, the processing routine is returned to step A03 and the next paper feeder is selected. In the last case, an error is notified to the operator and the process is finished (step A08).

In the foregoing case, although the size of medium is not described, preferably in step A05, when a designating command of a size of medium is received from the host, the coincidence is discriminated with respect to the above items including the size of medium.

When the print mode is designated and the paper feed is selected as mentioned above, a check is made in step 813 to see if there is a page to be outputted. If NO, the processing routine is returned to step 802 and data is inputted. When there is the page to be outputted, a check is made in step 814 to see if the automatic mode has been set. When the automatic mode is not set, a check is made in step 815 to see if the print medium has been enclosed in the current paper feeder. If the print medium is not enclosed, an error is notified in step 816. This error can be cancelled by supplementing the print media into the current paper feeder or by again selecting the paper feeder by the operation panel 1012. When the automatic selecting mode is confirmed in step 814, the paper feeder is automatically selected in consideration of the print medium and the print mode in a manner similar to the process in step 811 (step 817).

Subsequently, in step 818, by checking the tables 501 and 502 in FIG. 5, a check is made to see if the print mode which is available in the selected paper feeder and the print mode designated in step 807 coincide, namely, whether the printing by the print mode designated in the selected paper feeder is possible or not is discriminated. For example, in the case where the OHP is designated as a print mode in spite of a fact that the cassette (1) has been selected as a paper feeder, an error is notified in step 819. In this case, if the automatic mode is selected in step 810, since the paper feeder in which the print mode is available has been selected, no error is notified. When the error is notified in step 819, by changing the paper feeder, the error can be cancelled.

Subsequently, a check is made in step 820 to see if the print medium corresponding to the designated print mode and the print media actually enclosed coincide. In this case, the kind of print medium can be detected by the detecting sensor 1014 provided in the LBP. When the print media do not coincide, an error is notified in step 821. For example, in the case where the enclosed print medium is the OHP in spite of a fact that the print mode is designated as a thick paper, an error is notified. In this case, the operator can cancel the error by making the print medium coincide with the correct medium or by performing an error skip. In case of the error skip, in step 822, the designation according to the enclosed print media is performed for the printer engine. When the print medium corresponding to the print mode coincides with the print media which were actually enclosed, the print data is outputted in the print mode designated in step 807 (step 822).

Subsequently, a check is made in step 823 to see if there is still any other page to be outputted. When there is the page to be outputted, the processing routine is returned to step 813 and the processes mentioned above are repeated. When there is not the page to be outputted, it is assumed that all of the print documents have been printed, and the printing process is finished (step 824).

[Second Embodiment]

Although the embodiment has been described on the assumption that the detecting sensor 1014 to detect the print medium is provided, an example in the case where there is no detecting sensor will now be described. The second embodiment is similar to the first embodiment except that there is no detecting sensor 1014, an overlapped description is omitted, and different points will now be mainly explained.

FIG. 6 shows another command which is designated from the host 201 serving as a data source. This command is constructed by: an ESC code 601 showing that this command is the control command; a code 602 showing that this command is a setting command of the tentative print medium of the paper feeder; a code 603 showing the kind of tentative print medium; and a code 604 showing the kind of paper feeder.

FIG. 7 is a diagram showing an example of the relation between the paper feeder and the tentative print medium. The kind of paper feeder is shown in a left column 701. The kind of print medium which is tentatively set to each paper feeder is shown in a right column 702. For example, a print medium "thick" 704 is tentatively set to an MP 703. A print medium "thick" 706 is tentatively set to an upper cassette 705. A print medium "standard" 708 is tentatively set to a lower cassette 707.

Figure 9:
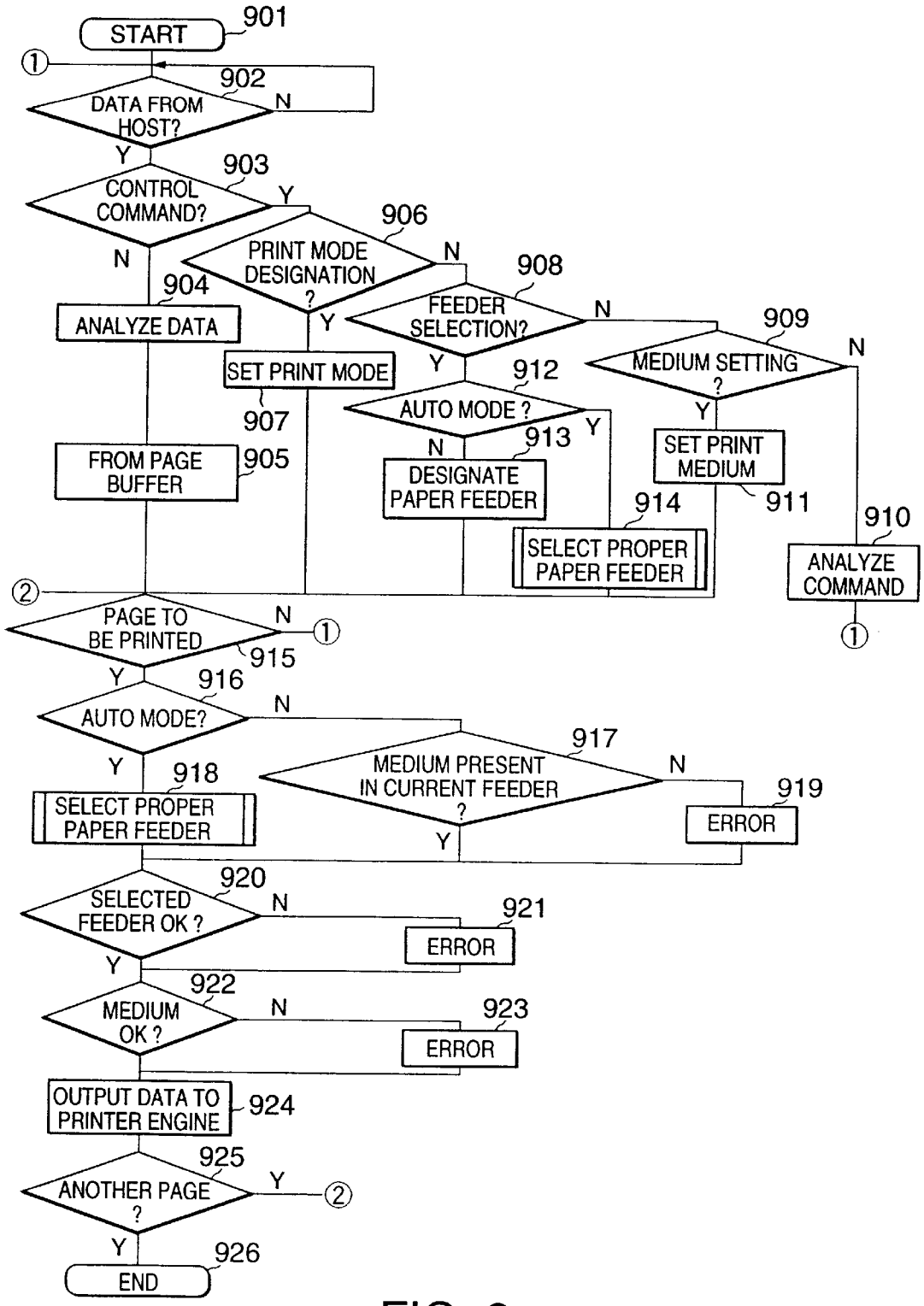
FIG. 9 is a flowchart showing a print processing procedure in the second embodiment of the invention.

The operation of the embodiment will now be described with reference to a flowchart shown in FIG. 9.

First in step 901, when the power source is turned on, the present program is started. In step 902, a check is made to see if data has been received from the host computer 201 to the port. When there is no data, this checking process is repeated.

When the data is received, a check is made in step 903 to see if the received data indicates the control command. When it is not the control command, since it is the print data, the received data is analyzed and is converted into an internal code in step 904. The internal code is written into the page buffer 206 in step 905.

When it is determined in step 903 that the received data is the control command, a check is made in step 906 to see if the control command is the designating command of the print mode by referring to the next code (code 302 in FIG. 3). When it is decided in step 906 that the control command is the designating command of the print mode, the print mode of the code 303 (FIG. 3) is set in step 907. When it is decided in step 906 that the control command is not the designating command of the print mode, a check is made in step 908 to see if the control command is the selecting command of the paper feeder.

When it is decided in step 908 that the control command is not the selecting command of the paper feeder, a check is made in step 909 to see if the control command is the setting command of the medium. If NO, the control command is analyzed in step 910 and is written into the page buffer 206 if necessary.

When it is determined in step 909 that the control command is the setting command of the medium, the kind of medium shown by the code 603 of the control command shown in FIG. 6 and the paper feeder shown by the code 604 are set into the table in FIG. 7 in step 911. In this example, "thick" is tentatively set to the paper feeder MP, "thick" is tentatively set to the upper cassette, and "standard" is tentatively set to the lower cassette. By this setting, even in the printing apparatus without the print medium detecting function, when the paper feeder is decided, the print medium enclosed therein can be tentatively set.

On the other hand, when it is determined in step 908 that the control command is the selecting command of the paper feeder, whether the mode is the automatic mode or not is confirmed in step 912 by referring to the code 403 in FIG. 4. When the selecting mode of the paper feeder is the automatic mode, a check is made in step 914 to see if there is the print medium in the current paper feeder. If there is no medium, the paper feeder in which the print mode designated in step 907 is possible is set to the selection target and is shifted to the paper feeder in which the print media corresponding to the print mode exist. The discrimination about whether the designated print mode is possible or not can be made by referring to the relation of 501 and 502 in FIG. 5. For example, when the print mode relates to "standard", only the upper and lower cassettes become the selection targets. On the other hand, when it is determined in step 912 that the selecting mode is not the automatic mode, the paper feeder is shifted to the paper feeder designated in step 913.

As mentioned above, when the print mode is designated and the paper feeder is selected, the presence or absence of the page to be outputted is discriminated in step 915. When there is no page to be outputted, the processing routine is returned to step 902 and the data is inputted. When there is the page to be outputted, a check is made in step 916 to see if the selecting mode is the automatic mode. When it is not the automatic mode, a check is made in step 917 to see if the print media have been stored in the current paper feeder. When the print media do not exist, an error is notified in step 919. This error can be cancelled by supplementing print media to the current paper feeder or by again selecting the paper feeder by the operation panel 1012. When it is confirmed in step 916 that the selecting mode is the automatic mode, the paper feeder is automatically selected in consideration of the print medium and the print mode (step 918) in a manner similar to the process in step 914.

Figure 10:
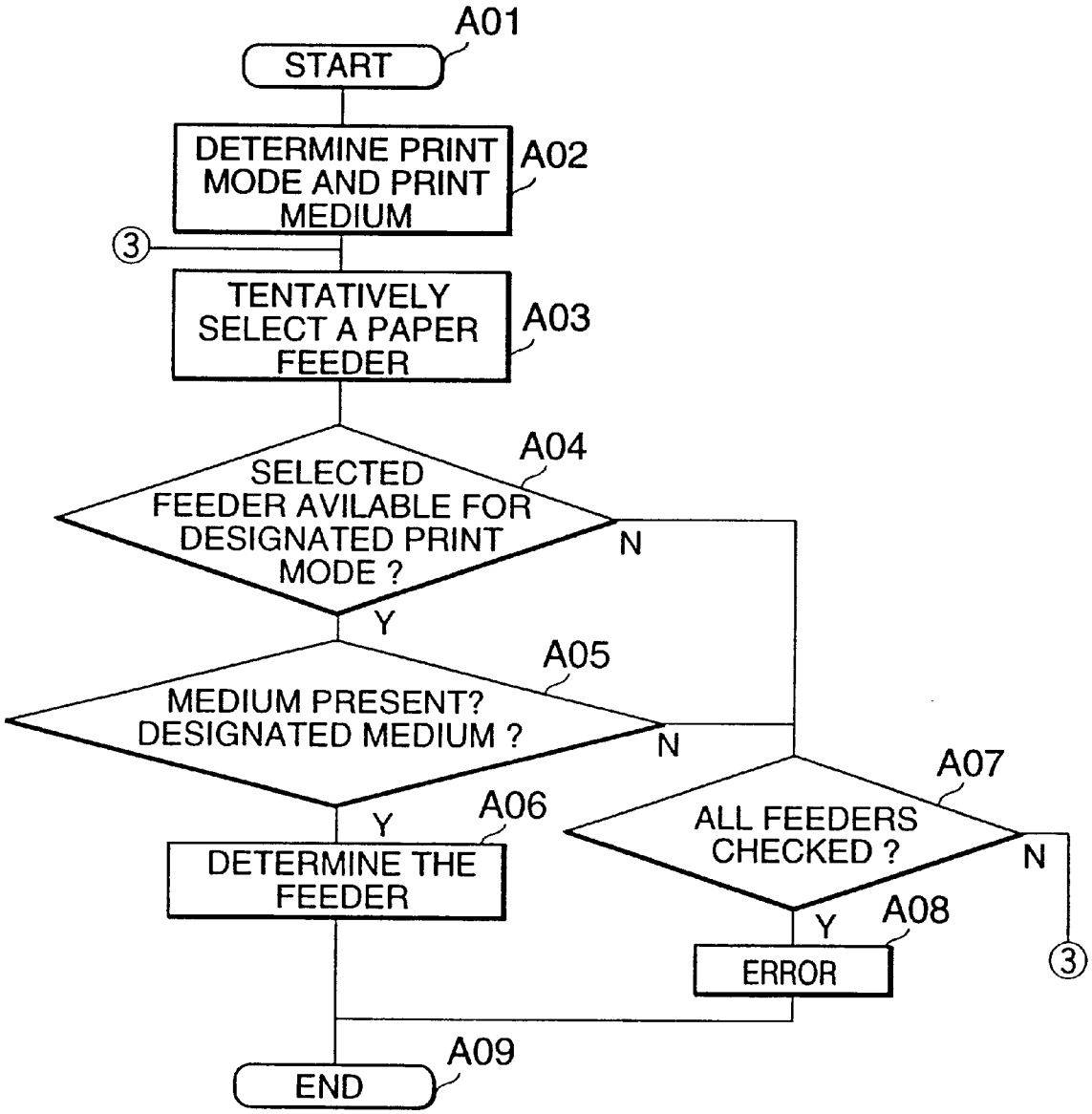
FIG. 10 is a flowchart showing a selection processing procedure of a paper feeder in the first or second embodiment of the invention.

The selecting operations of the paper feeder in steps 914 and 918 are similar to the processes shown in FIG. 10. Preferably, the discrimination in step A05 is performed with reference to the table in FIG. 7 with regard to the paper feeder in which the print medium has been tentatively set and is executed with reference to the table in FIG. 5 with respect to the paper feeder in which the print medium is not set.

Subsequently in step 920, by checking the tables of 501 and 502 in FIG. 5, a check is made to see if the print mode which is possible in the selected paper feeder and the print mode designated in step 907 coincide, namely, whether the printing in the designated print mode can be performed in the selected paper feeder or not is discriminated. For example, when the OHP is designated as a print mode in spite of a fact that the upper cassette has been selected as a paper feeder, an error is notified in step 921. In this case, when the automatic mode is selected in step 912, since the paper feeder in which the print mode is available has been selected, no error is notified. When the error is notified in step 921, the error can be cancelled by changing the paper feeder.

A check is made in step 922 to see if the print medium corresponding to the designated print mode and the actual print medium coincide. In this case, the kind of print medium is detected with reference to the table shown in FIG. 7. When the print media do not coincide, an error is notified in step 923. For example, when the MP 703 is selected in FIG. 7, the kind of print medium has been tentatively set to "thick" 704. Therefore, when the OHP is designated as a print mode in step 907, an error is notified. In this case, the operator can cancel the error by making the print medium coincide with the correct medium and by changing the tentatively set print medium by the operation panel. In case of an error skip, in step 924, the designation according to the tentatively set print medium is performed for the printer engine. On the other hand, when the print medium corresponding to the print mode and the tentatively set print medium coincide, the print data is outputted in the print mode designated in step 907 (step 924).

Subsequently, a check is made in step 925 to see if there is still another page to be outputted. When there is the page to be outputted, the processing routine is returned to step 915 and the processes mentioned above are repeated. When there is no page to be outputted, it is regarded that all of the print documents have been printed, and the printing process is finished (step 926).

What is claimed is:

1. A printing apparatus comprising:

a plurality of paper feeding units;

a setting unit, adapted for setting a plurality of print medium types on said plurality of paper feeding units;

a processing unit, adapted for analyzing data received from a host computer, for executing a discrimination of whether a print medium type designated in the received data coincides with one of the plurality of print medium types set for one of the plurality of paper feeding units by said setting unit, and for executing a selection of the one paper feeding unit if the designated print medium type coincides with the set print medium type, said processing unit executing the discrimination and the selection for a next one of the plurality of print medium types if the designated print medium type does not coincide with the set print medium type; and a print unit, adapted for printing data on a medium fed by one of the plurality of paper feeding units selected by said processing unit.

2. An apparatus according to claim 1, wherein said processing unit executes an error notification process if the designated print medium type coincides with none of the plurality of print medium types.

3. An apparatus according to claim 1, wherein said setting unit sets the plurality of print medium types in response to a command designating a paper feeding unit and a print medium type received from a host.

4. A print control apparatus comprising:

a setting unit, adapted for setting a plurality of print medium types on respective paper feeding units; and a processing unit, adapted for analyzing data received from a host computer, for executing a discrimination of whether a print medium type designated in the received data coincides with one of the plurality of print medium types set for one of the paper feeding units by said setting unit, and for executing a selection of the one paper feeding units if the designated print medium type coincides with the set print medium type, said processing unit executing the discrimination and the selection for a next one of the plurality of print medium types if the designated print does not coincide with the set print medium type.

5. An apparatus according to claim 4, wherein said processing unit executes an error notification process if the designated print medium types coincides with none of the plurality of print medium types.

6. An apparatus according to claim 4, wherein said setting unit sets the plurality of print medium types in response to a command designating a paper feeding unit and a print medium type received from a host.

7. A method of selecting a paper feeding unit, comprising:

a setting step of setting a plurality of print medium types on respective paper feeding units; and a processing step of analyzing data received from a host computer of executing a discrimination of whether a print medium type designated in the received data coincides with one of the plurality of print medium types set for one of the paper feeding unit in said setting unit, and of executing a selection of the one paper feeding unit if the designated print medium type coincides with the set print medium type, said processing step executing the discrimination and the selection for a next one of the plurality of print medium types if the designated print medium type does not coincide with the set print medium type.

8. A method according to claim 7, wherein said processing step executes an error notification process if the designated print medium type coincides with none of the plurality of print medium types.

9. A method according to claim 7, wherein said setting step sets the plurality of print medium types in response to a command designating a paper feeding unit and a print medium type received from a host.

* * * * *

UNITED STATES PATENT AND TRADEMARK OFFICE

CERTIFICATE OF CORRECTION

PATENT NO. : 6,682,236 B2
DATED : January 27, 2004
INVENTOR(S) : Yuichi Higuchi

It is certified that error appears in the above-identified patent and that said Letters Patent is hereby corrected as shown below:

Column 10,
Line 1, “types” should read -- type --.
Line 13, “unit” should read -- units --.

Signed and Sealed this

Eighth Day of June, 2004

JON W. DUDAS
*Acting Director of the United States Patent and Trademark Office*